US006219521B1

(12) United States Patent
Burdick et al.

(10) Patent No.: US 6,219,521 B1
(45) Date of Patent: Apr. 17, 2001

(54) BELT FUSER WIPER TO REMOVE MOISTURE

(75) Inventors: Robert Leonard Burdick, Lancaster; Ann Marie Garland, Nicholasville; Peter Alden Bayerle, Lexington; Harald Portig, Versailles; Douglas Campbell Hamilton, Lexington, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/491,610

(22) Filed: Jan. 26, 2000

(51) Int. Cl.[7] ..... G03G 15/20
(52) U.S. Cl. ..... 399/327
(58) Field of Search ..... 399/327, 328, 399/331, 333

(56) References Cited

U.S. PATENT DOCUMENTS

| | | | | |
|---|---|---|---|---|
| 3,883,292 | * | 5/1975 | Hamaker | 399/327 X |
| 3,921,573 | * | 11/1975 | Thettu | 399/327 X |
| 4,518,976 | * | 5/1985 | Tarumi et al. | 399/331 X |
| 4,645,327 | | 2/1987 | Kimura et al. | 355/3 R |
| 4,822,978 | | 4/1989 | Morris et al. | 219/216 |
| 5,091,752 | | 2/1992 | Okada | 355/285 |
| 5,138,395 | | 8/1992 | Lindblad et al. | 355/299 |
| 5,223,902 | | 6/1993 | Chodak et al. | 355/290 |
| 5,307,133 | | 4/1994 | Koshimizu et al. | 355/285 |
| 5,353,106 | * | 10/1994 | Agarwal et al. | 399/327 |
| 6,026,272 | * | 2/2000 | Kusaka et al. | 399/327 |

* cited by examiner

*Primary Examiner*—Fred L Braun
(74) *Attorney, Agent, or Firm*—John A. Brady

(57) ABSTRACT

An image-fixing device for use in an electrophotographic process which includes a wiping member (61,62,64,67) in contact with the back-up roller of the fusing portion of the device is disclosed. This wiping member eliminates moisture condensation on the back-up roller (51). This acts to eliminate stalls and paper jams without requiring major reformulation of the compositions of the fuser belt or back-up roll or the structure of the printer.

19 Claims, 6 Drawing Sheets

BELT FUSER WIPER TO REMOVE MOISTURE

TECHNICAL FIELD

This invention relates to electrophotographic processes and, particularly, to the prevention of stalling and paper jams in an electrophotographic printer by eliminating the accumulation of moisture in the toner belt fusing apparatus.

BACKGROUND OF THE INVENTION

In electrophotography, a latent image is created on the surface of an insulating, photoconducting material by selectively exposing an area of the surface to light. A difference in electrostatic charge density is created between the areas on the surface exposed and those unexposed to the light. The latent electrostatic image is developed into a visible image by electrostatic toners, containing pigment components and thermoplastic components. The toners, which may be liquids or powders, are selectively attracted to the photoconductor's surface, either exposed or unexposed to light, depending upon the relative electrostatic charges on the photoconductor's surface, development electrode, and the toner. The photoconductor may be either positively or negatively charged, and the toner system similarly may contain negatively or positively charged particles.

A sheet of paper or intermediate transfer medium is given an electrostatic charge opposite that of the toner and then passed close to the photoconductor's surface, pulling the toner from the photoconductor's surface onto the paper or intermediate medium still in the pattern of the image developed from the photoconductor's surface. A set of fuser rollers or belts, under heat, melts and fixes the toner in the paper, subsequent to direct transfer or indirect transfer when an intermediate transfer medium is used, producing the printed image.

The electrostatic printing process, therefore, comprises an intricate and ongoing series of steps in which the photoconductor's surface is charged and discharged as the printing takes place. In addition, during the process, various charges are formed on the photoconductor's surface, the toner and the paper surface to enable the printing process to take place. Having the appropriate charges in the appropriate places at the appropriate times is critical to making the process work.

After the image is transferred to the paper or other recording medium, it goes to the fuser where the paper is moved through a nip where it is heated and pressed. This melts the thermoplastic portion of the toner, causing it to intermingle with the fibers of the paper, thereby bonding the image onto the paper. While this is an effective way of fixing the toner image on the paper's surface, it carries with it some negative consequences. Specifically, various types of copy media, such as bond paper and tracing paper, contain significant amounts of moisture. During the passage of the paper through the fusing area, this moisture is heated and evaporates. The steam vapor can then escape into other portions of the printer creating the potential for rust and corrosion, which can inhibit long-term machine performance. The steam can condense and form puddles in entrapment areas. The moisture can also condense on the surface of the back-up or pressure roller in the fuser. When it does so, it is carried around to the fuser nip, reducing the coefficient of friction between the back-up roller, the paper and the fuser belt, causing the paper to slip. This slippage delays the arrival of the paper at the exit sensor, registering as a paper-feed failure, causing the machine to stop. In another scenario, the slippage of the belt, caused by moisture in the fuser area, causes the paper to not enter the fuser nip thereby producing a fuser jam. In both cases, the printer ceases operation, requiring that the operator clear and restart it, delaying completion of the printing project underway.

The problems caused by moisture are particularly acute where the printer utilizes a fuser belt, rather than a fuser roll, especially one which is not self-driven, but rather is driven by friction between the belt, the paper and the back-up roller (which is driven). In this commonly used apparatus, when moisture condenses on the back-up roller, it wets the fuser nip and the fuser belt. This can result in slippage between the fuser belt, the paper and the back-up roller which delays arrival of the paper at the exit sensor, causing the printer to stop. This requires that the operator clear the paper path and restart the printer in order to complete the print job. Another problem caused by the presence of moisture is the result of back-up roller/fuser belt slippage. Such slippage can cause a paper bubble, as the paper enters the fuse nip, which not only can result in a paper jam, but can also cause the paper to rub against fuser surfaces, causing the unfixed toner to be smeared. As used herein, these problems are collectively referred to as "fuser stalls."

It is clear that, for several reasons, it is important to effectively remove moisture, created by the fusing process, from the back-up roller in the belt fuser. The present development defines an effective way to accomplish this goal.

Although the prior art recognizes that the production of moisture by the fusing process is undesirable, there are few methods suggested for combating this problem and those methods which have been suggested have significant drawbacks associated with them.

U.S. Pat. No. 5,223,902, Chodak, et al., issued Jun. 29, 1993, describes a moisture collection and removal system for a fuser. The fuser involved does not use a back-up or pressure roller, but rather forms a fusing nip between the fuser roller and a pad biased against the fuser roller. In this system, moisture condenses and falls by gravity into a collection area; a wiper is not used. The printing apparatus described is relatively large, such as those used for making blueprints. This large size provides a significant amount of space which may be used for dealing with the moisture problem. Large amounts of space are not available in a desktop printer or copy machine, making it much more of a challenge to deal with the moisture issue.

U.S. Pat. No. 4,822,978, Morris, et al., issued Apr. 18, 1989, describes a fuser apparatus which utilizes a low-mass fuser roller and a flexible web to keep sheets of paper in biased contact with the fuser roller. The web contains perforations that allow accumulated moisture to escape from the fuser system; the moisture can then be wiped from the outer surface of the web. There is no back-up roll utilized in this system and no structure is given for the wiping mechanism. Again, this apparatus is suggested for use in a relatively large printer and would not be useful in a smaller desktop model with its associated space constraints.

U.S. Pat. No. 4,645,327, Kimura, issued Feb. 24, 1987, describes an apparatus for preventing condensation of moisture on the surface of a photoconductor. It does not address the issue of moisture in the fusing system. This patent describes (see column 10, lines 31 et. seq.) a wiper comprised of an aluminum shaft having layers of felt and/or urethane sponge to wipe moisture off the photoreceptor drum. Such a wiper structure is not generally effective in dealing with the moisture problem, since it tends to absorb water until it becomes saturated, at which time it begins feeding water back onto the surface of the photoreceptor.

U.S. Pat. No. 5,307,133, Koshimizu, et al., issued Apr. 26, 1994, addresses the problem of moisture condensation on the fuser apparatus by incorporating a fan into the printer to eliminate water vapor in the air. This is an indirect way of addressing the problem that is not as effective as directly addressing the issue of moisture accumulation on the back-up roller.

U.S. Pat. No. 5,091,752, Okada, issued Feb. 25, 1992, addresses the moisture condensation issue by incorporating a heat-insulating surface layer on the back-up roller. This approach requires reformulation of the rollers in the printer. It would be highly desirable to be able to effectively address the moisture condensation issue without having to significantly modify the structure of the rollers.

Concurrently-filed U.S. patent application Ser. No. 09/491,278 Hamilton, et al., Back-up Roll with Reduced Mass, describes a back-up roller used in the fusing portion of an electrophotographic process, comprising an inner metal core and an outer hollow shell surrounding the core, with a plurality of metal ribs between the core and the shell. This roller reduces the condensation of moisture on its surface.

It has now been found that moisture accumulation on the back-up roller can be minimized or eliminated by utilizing a wiping element, such as a brush, made from a high-surface energy material, in contact with the surface of the back-up roller. This approach not only effectively removes moisture from the back-up roller, thereby eliminating stalling, paper jams and corrosion of parts, but it achieves those ends effectively, inexpensively, in a manner suited to the small spaces available in a desktop printer, and without requiring redesign of the fuser belt and back-up roller.

SUMMARY OF THE INVENTION

The present invention encompasses an image-forming device comprising:

a heated movable fixing member and rotatable back-up member forming a nip therebetween, which members transport a recording material through said nip, thereby fixing toner to create an image on said recording material;

means for driving at least one of said members; and at least one wiping element, comprising a high surface energy material, in contact with at least a portion of the surface of said back-up member and having a generally flat surface extending away from the back-up member to move water away from the back-up member.

In preferred embodiments, the wiping element is a brush or a plurality of brushes made from fine stainless steel wire.

DETAILED DESCRIPTION OF THE INVENTION

The present invention relates to the inclusion of a wiping element, made from a high surface energy material, in contact with back-up roll of a fuser used to fix images in an electrophotographic process. By using this wiper, condensed moisture is eliminated from the back-up roller, thereby avoiding paper jams and fuser stalls in a very simple and cost-effective manner, without requiring major redesigns of the fuser belt or back-up roller.

Figure 1:
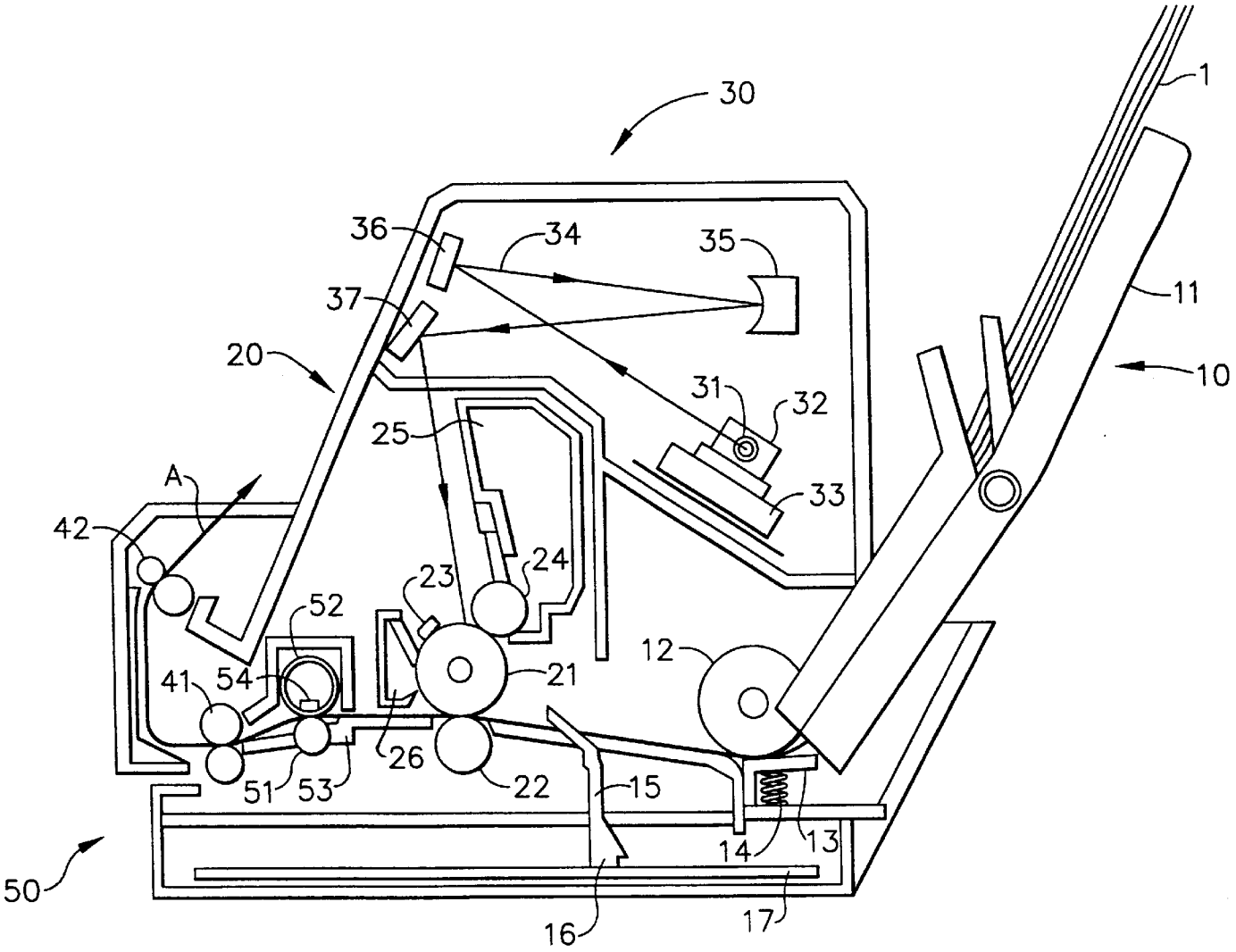
FIG. 1 is a schematic, side view of a laser printer representing a typical electrophotographic apparatus, particularly one used in a desktop printer or copier.

A standard laser printer, a representative electrophotographic device, is shown in FIG. 1. It includes a paper-feed section (10), an image-forming device (20), a laser-scanning section (30), and a fixing device (50). The paper-feed section (10) sequentially transports sheets of recording paper (1) to the image-forming device (20) provided in the printer. The image-forming device (20) transfers a toner image to the transported sheet of recording paper (1). The fixing device (50) fixes the toner to the sheet of recording paper (1) sent from the image-forming device (20). Thereafter, the sheet of recording paper (1) is ejected out of the printer by paper transport rollers (41, 42). In short, the sheet of recording paper (1) moves along the path denoted by the arrow (A) in FIG. 1.

The paper-feed section (10) includes a paper-feed tray (11), a paper-feed roller (12), a paper separating friction plate (13), a pressure spring (14), a paper detection actuator (15), a paper detection sensor (16), and a control circuit (17).

Upon receiving a print instruction, the sheets of recording paper (1) placed in the paper-feed tray (11) are fed one-by-one into the printer by operation of the printer feed roller (12), the paper separating friction plate (13) and the pressure spring (14). As the fed sheet of recording paper (1) pushes down the paper detection actuator (15), the paper-detection sensor (16) outputs an electrical signal instructing commencement of printing of the image. The control circuit (17), started by operation of the paper detection actuator (15), transmits an image signal to a laser diode light-emitting unit (31) of the laser scanning section (30) so as to control on/off of the light-emitting diode.

The laser scanning section (30) includes the laser diode light-emitting unit (31) a scanning mirror (32), a scanning mirror motor (33), and reflecting mirrors (35, 36, 37).

The scanning mirror (32) is rotated at a constant high speed by the scanning mirror motor (33). In other words, laser light (34) scans in a vertical direction to the paper surface of FIG. 1. The laser light (34) radiated by the laser diode light-emitting unit (31) is reflected by the reflecting mirrors (35, 36 and 37) so as to be applied to a photosensitive body (21). When the laser light (34) is applied to the photosensitive body (21), the photosensitive body (21) is selectively exposed to the laser light (34) in accordance with on/off information from the control circuit (17).

The image-forming device (20) includes the photosensitive body (21), a transfer roller (22), a charging member (23), a developing roller (24), a developing unit (25) and a cleaning unit (26). The surface charge of the photosensitive body (21), charged in advance by the charging member (23), is selectively discharged by the laser light (34). An electrostatic latent image is thus formed on the surface of the photosensitive body (21). The electrostatic latent image is visualized by the developing roller (24) and the developing unit (25). Specifically, the toner supplied from the developing unit (25) is adhered to the electrostatic latent image on the photosensitive body (21) by the developing roller (24) so as to form the toner image.

Toner used for development is stored in the developing unit (25). The toner contains coloring components (such as carbon black for black toner) and thermoplastic components. The toner, charged by being appropriately stirred in the developing unit (25) adheres to the above-mentioned electrostatic latent image by an interaction of the developing biased voltage applied to the developing roller (24) and an electric field generated by the surface potential of the photosensitive body (21), and thus conforms to the latent image, forming a visual image on the photosensitive body (21). The toner typically has a negative charge when it is applied to the latent image forming the visual image.

Next, the sheet of recording paper (1) transported from the paper-feed section (10) is transported downstream while being pinched by the photosensitive body (21) and the transfer roll (22). The recording paper (1) arrives at the transfer nip in timed coordination with the toned image on the photosensitive body (21). As the sheet of recording paper (1) is transported downstream, the toner image formed on the photosensitive body (21) is electrically attracted and transferred to the sheet of recording paper (1) by an interaction with the electrostatic field generated by the transfer voltage applied to the transfer roller (22). Any toner that still remains on the photosensitive body (21), not having been transferred to the sheet of recording paper (1), is collected by the cleaning unit (26). Thereafter, the sheet of recording paper (1) is transported to the fixing device (50). In the fixing device (50), an appropriate temperature and pressure are applied while the sheet of recording paper (1) is being pinched by moving through the nip formed by the pressure (or back-up) roller (51) and the fixing belt (52) that is maintained at a constant temperature. The thermoplastic components of the toner are melted by the fixing belt (52) and fixed to the sheet of paper (1) to form a stable image. The sheet of recording paper (1) is then transported and ejected out of the printer by the printer transport rollers (41 and 42).

Next, the operation of the fixing device (50) will be described in detail. The fixing device (50) includes the back-up (or pressure) roller (51) and the fixing belt (52). The fixing belt is generally an endless belt or tube formed from a highly heat resistive and durable material having good parting properties and a thickness of not more than about 100 $\mu$m, preferably not more than about 70 $\mu$m. Preferred belts are made from a polyimide film. The belt may have an outer coating of, for example, a fluororesin or Teflon material, to optimize release properties of the fixed toner from the belt. Such fuser belts are very well-known in the art. A heater (54), generally a ceramic heater, is placed on the inside surface of the belt and the outside surface of the belt forms a fusing nip with the back-up roller (51) at the point of the heater. Each page carrying the toner travels through this nip and the toner is fixed on the page through the combination of applied heat and pressure. Typically, the pressure between the fuser belt (52) and the back-up roller (51) at the fuser nip is from about 5 to about 30 psi. Although the fuser belt (52) may be driven itself, often this is not the case. Generally, the back-up roller (51) is rotated and it is the friction between the surface of the back-up roller (51) and the printed page and ultimately the surface of the fuser belt (52), which causes the fuser belt (52) to rotate. That is why maintaining the appropriate coefficient of friction in the fuser nip is so important and why the presence of moisture in the nip can cause slippage and fuser stall.

The back-up or pressure roller (51) is cylindrical in shape. It is made from or is coated with a material that has good release and transport properties for the recording paper (1). The back-up roller (51) is sufficiently soft so as to allow it to be rotated against the fuser belt (52) to form a nip through which the printed pages travel. By going through this nip, printed pages are placed under pressure and the combined effects of this pressure, the time the page is in the nip, and the heat from the fuser belt (52) acts to fix the toner onto the paper. A preferred material for use in forming the back-up roller (51) is silicone rubber. The roller typically has an aluminum core with a silicone rubber layer molded or adhesively bonded onto its surface. This roller may also have a fluoropolymer (e.g., Teflon) sleeve or coating.

Moisture in the paper being fused is converted to steam during the fusing process and driven from the paper. It subsequently condenses on the surface of the back-up roller (51), particularly when the temperature of the back-up roller (51) is relatively low, such as when the printer is starting up. The moisture is carried by the back-up roller (51) to the fuser entry nip and is pulled through the nip between the back-up roller (51) and the fuser belt (52). This moisture changes the coefficient of friction between the back-up roller (51) and the fuser belt (52), causing the belt (52) to stall. This moisture must be removed from the surface of the back-up roller (51) in order to keep the fuser functioning properly. The present invention uses a wiper fashioned from a high surface energy material, in contact with the surface of the back-up roller (51), to remove this moisture from the back-up roller (51) surface and thereby eliminate the stalling problem. The contact of the wiper with the back-up roller (51) is such that the water collected moves away from the surface of the back-up roller (51).

A high surface energy material, also known as a hydrophilic material, is a material the surface of which is easily wet by aqueous liquids. As used herein, "high surface energy material" means a material which has a surface energy which is higher than that of the material making-up the surface of the back-up roller (51). Examples of high surface energy materials include cotton, cellulose, Nomex (polyaramid fiber commercially available from DuPont), Kapton (a polyimide material commercially available from DuPont), and stainless steel, with stainless steel being particularly preferred. The back-up roller (51) generally has on its surface a low-surface energy material, such as Teflon. In that context, the water which condenses on the surface of the back-up roller (51) tends to "wet" the wiper which is made from the high surface energy material, as opposed to remaining on the Teflon (i.e., the low surface energy material). This acts to effectively remove the moisture from the surface of the back-up roller (51). FIGS. 2, 3, 4 and 5 illustrate four embodiments of the present invention.

Figure 2:
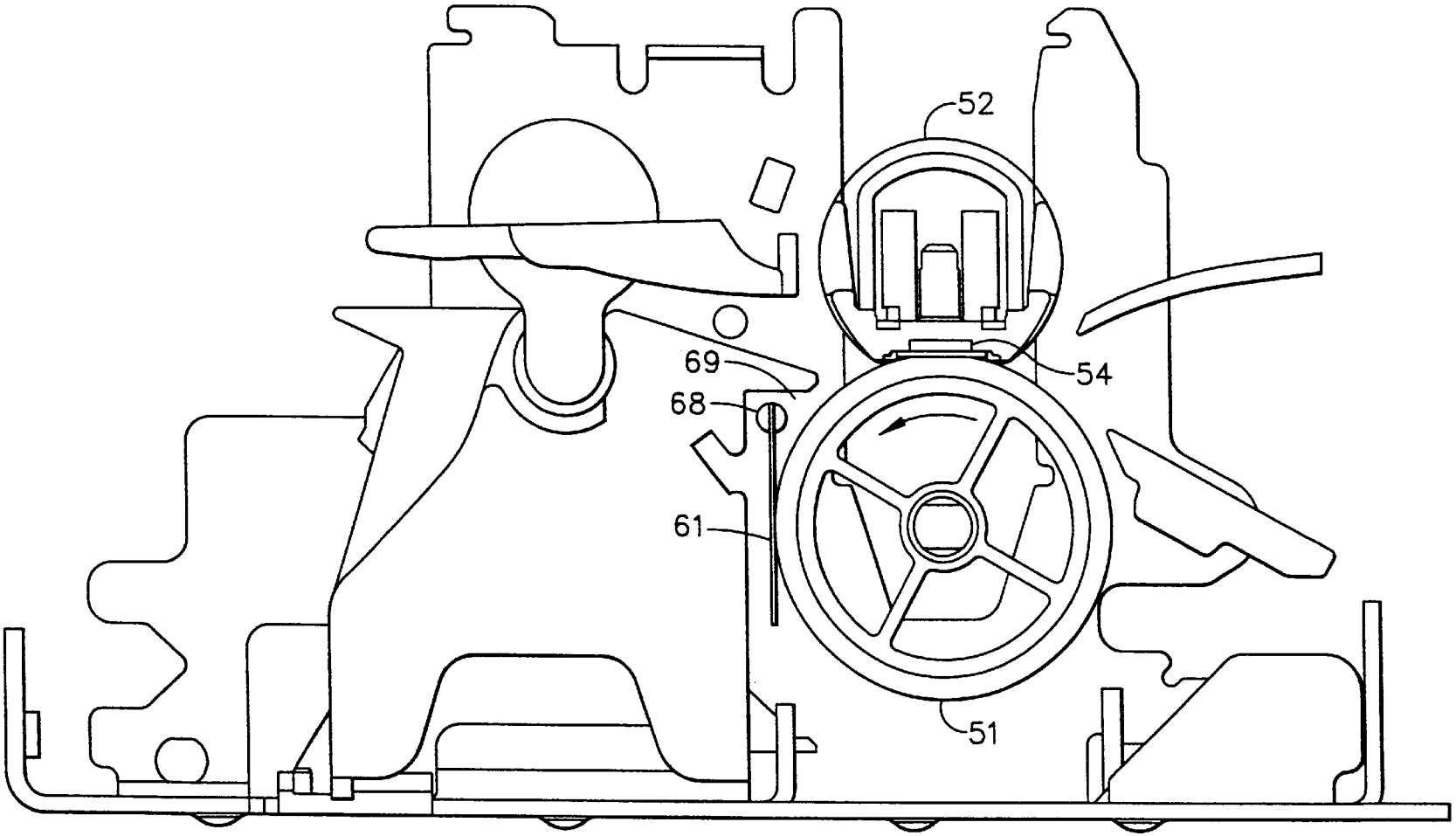
FIG. 2 is a schematic, side view of a laser printer showing the placement of a wiper of the present invention.

In FIG. 2, a sheet of Kapton (61) is suspended vertically and allowed to wipe the surface of the back-up roller (51). The wiper is attached to a shaft which is located by two holes (68) on the fuser frame (69). Kapton was chosen because it is a high surface energy material that can withstand the high surface temperatures of the back-up roller. It is a polyimide material, commercially available from DuPont. The back-up roller (51) has a Teflon (low surface energy material) sleeve as an outer coating. When used in a standard desktop printer (such as the Optra T612, commercially available from Lexmark International), the moisture which condenses on the surface of the back-up roller (51) is picked up by the surface of the Kapton sheet (61). Once on the Kapton sheet, the water moves down the sheet (by gravity) and falls on the fuser frame. This embodiment is not optimal in that, over time, the Kapton sheet can begin to conform to the shape of the back-up roller (51) and no longer hang properly. Under those circumstances, the sheet (61) may not afford appropriate contact with the surface of the back-up roller (51).

Figure 3:
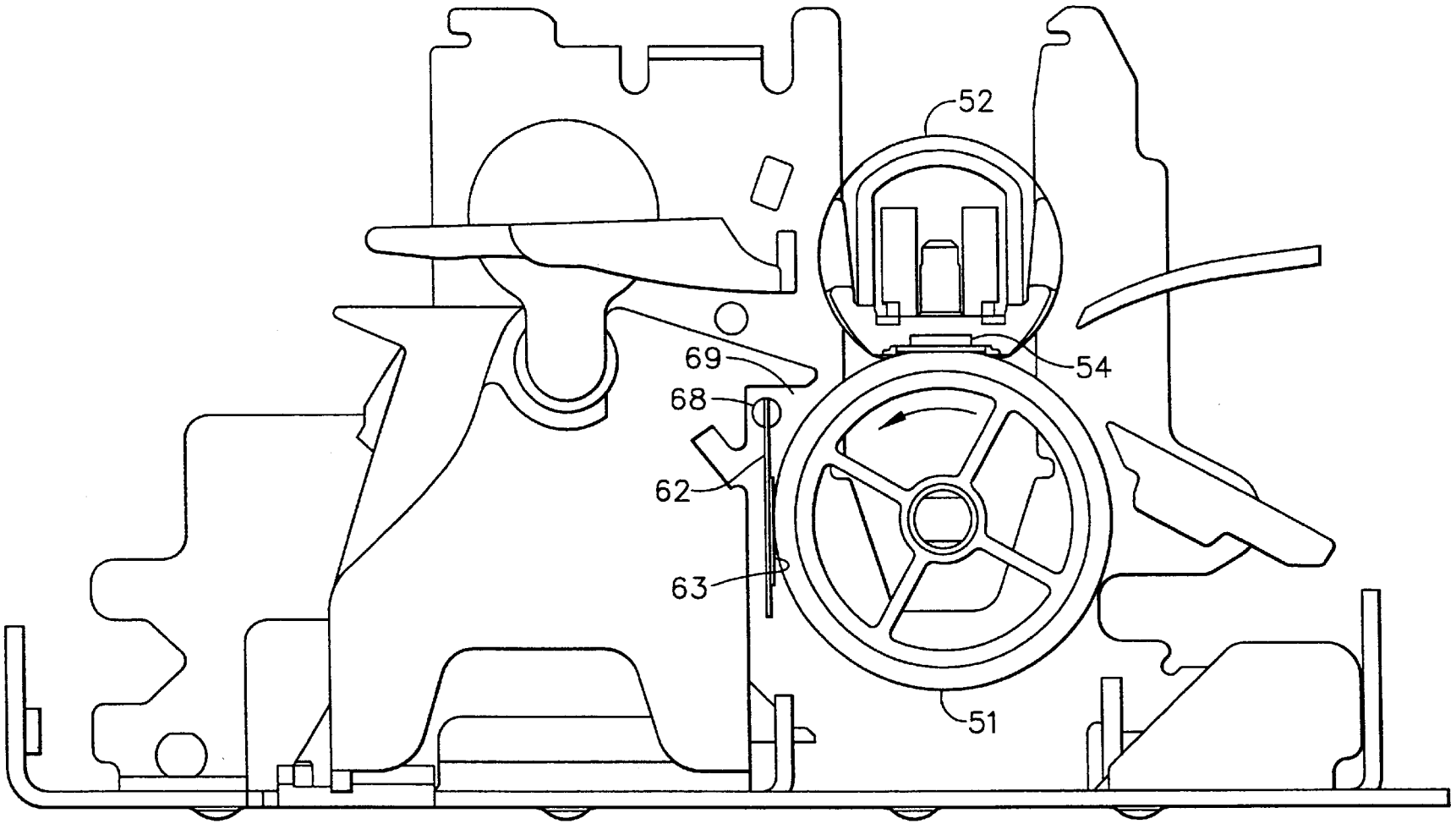
FIG. 3 is a schematic, side view showing the placement of a second embodiment of the wiper of the present invention.

In order to address this issue, the Kapton may be provided with additional reinforcement. In FIG. 3, a piece of Kapton tape (63) is attached to a thin (0.004 inch) sheet of stainless steel (62) and this tape is allowed to wipe the surface of the back-up roller (51). Again, the wiper is attached to a shaft which is located by two holes (68) on the fuser frame (69). In this regard, any relatively lightweight supporting substrate material, such as stainless steel or aluminum, could be used. Additionally, rather than Kapton, a layer of another high surface energy material could be placed on substrate. In FIG. 3, 62 denotes the stainless steel substrate and 63 denotes the Kapton tape placed on that substrate.

Figure 4:
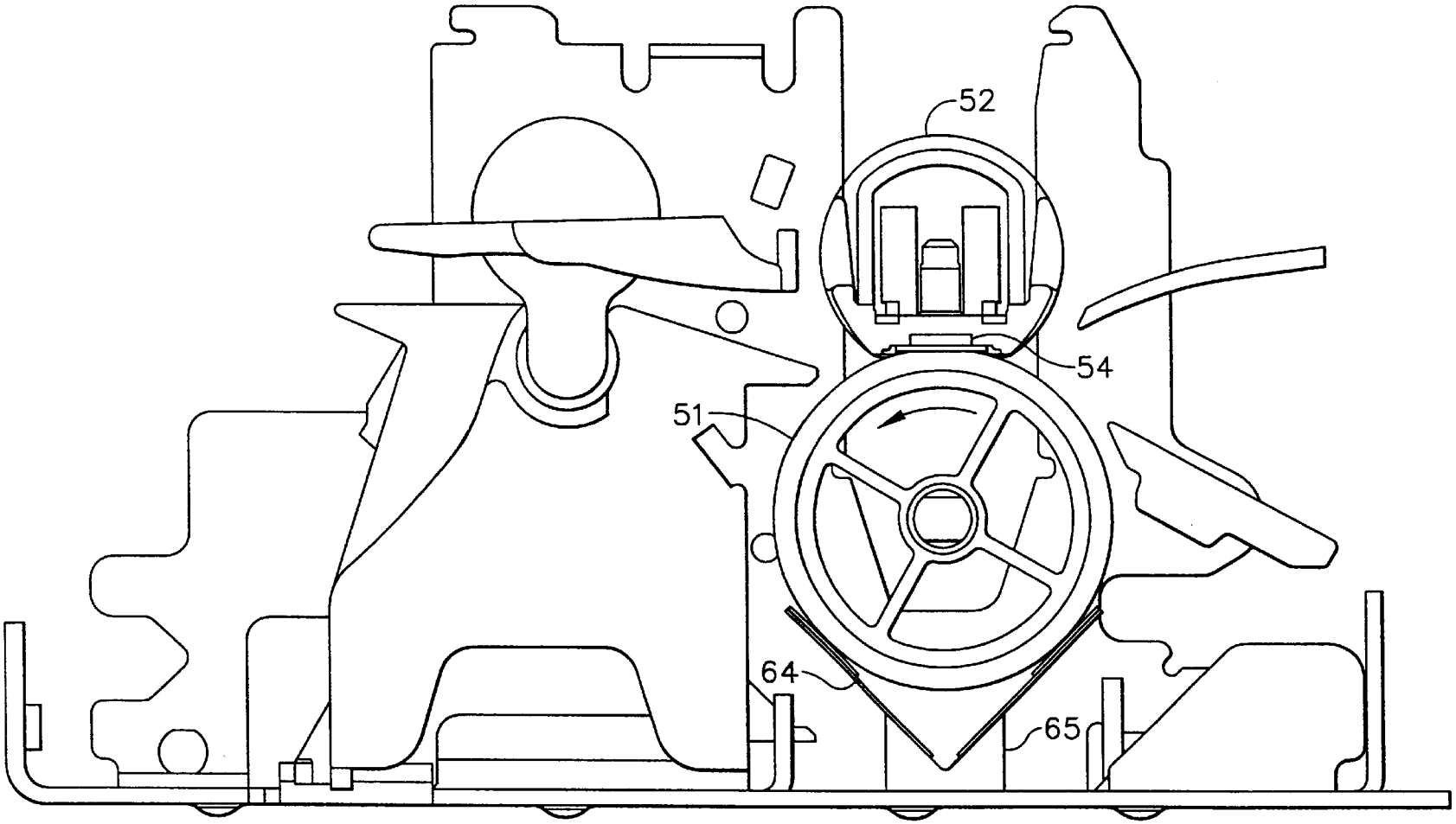
FIG. 4 is a schematic, side view showing the placement of a third embodiment of the wiper of the present invention.

FIG. 4 illustrates an embodiment of the present invention in the form of a "V"-shaped wiper. One leg of the "V" is in contact with the front portion of the back-up roller (51) (based on its direction of rotation) and the second leg is in contact with the back portion of the roller. The wiper is made, for example, from a stainless steel "V" with appropriate coatings placed on each leg of the "V" where they contact the back-up roller (51). The wiper is attached to the fuser frame by a plastic housing (65). The rationale behind this design is that the first leg of the "V" deals with contamination and the second leg of the "V" is to primarily remove the moisture. The purpose of the "V" shape is to self-center the wiper on the back-up roller (51). In this figure, 64 represents the "V"-shaped wiper and 65 represents the support for the wiper holding it in place on the back-up roller (51). A vertical wiper, such as those shown in FIGS. 2 or 3, when used, sometimes loads up with moisture from the surface of the back-up roll (51) and then releases a large droplet back onto the back-up roll surface which rotates around the roll and marks the paper coming through the fuser. The trailing wiper of the "V" pair acts to catch and disperse those large droplets.

Figure 5:
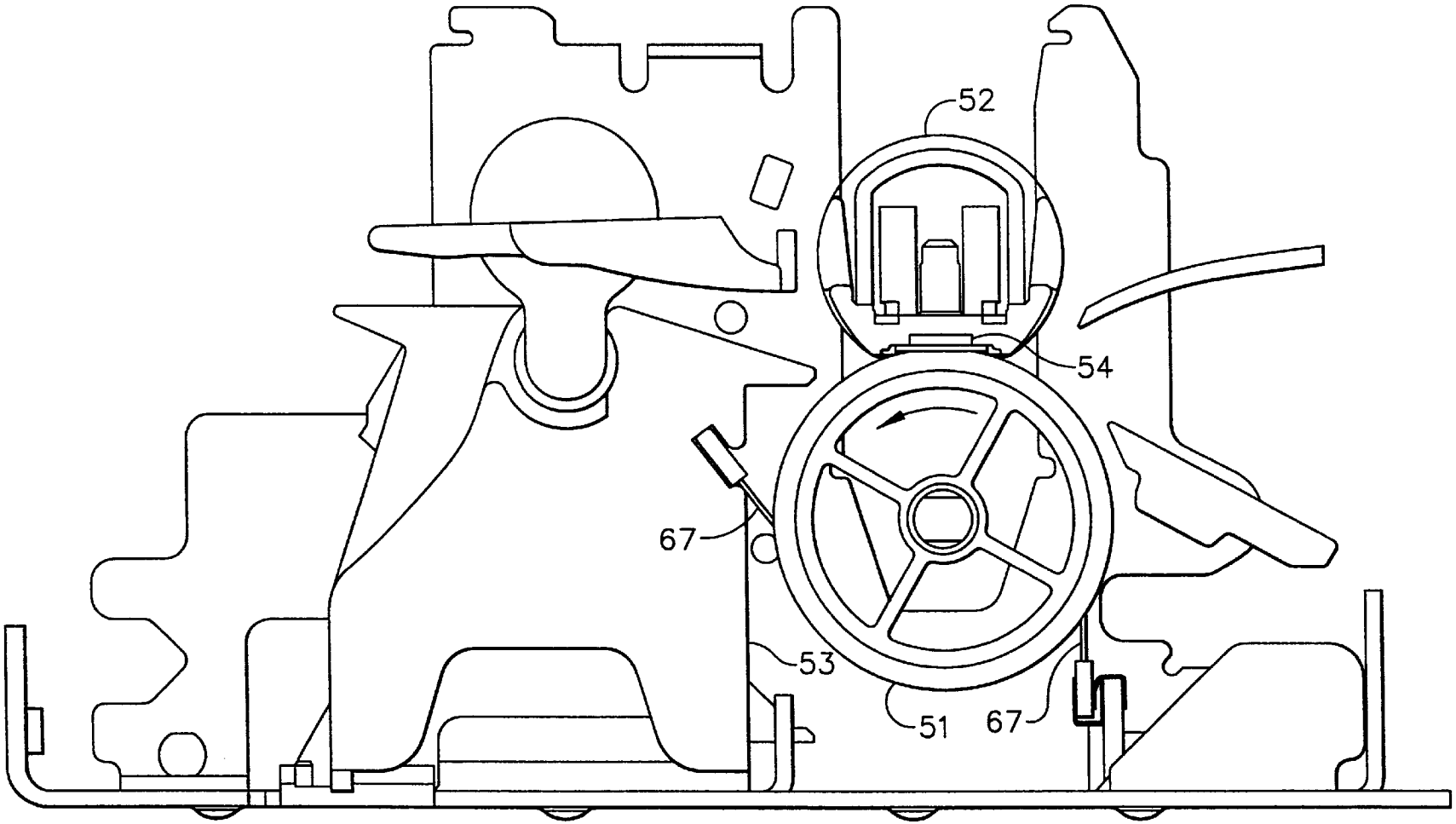
FIG. 5 is a schematic, side view showing the placement of a fourth and preferred embodiment of the present invention.
Figure 6A:
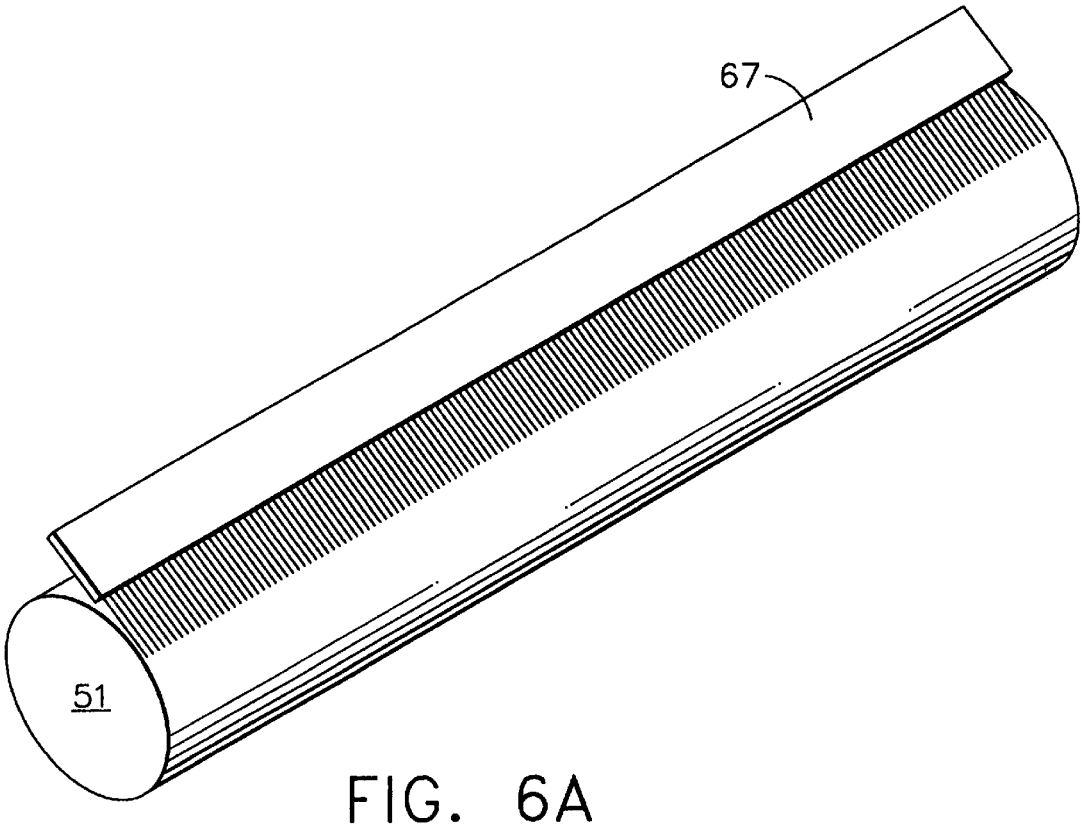
FIG. 6A and 6B are perspective views of back-up rollers showing wipers of the present invention in the form of stainless steel bristle brushes.
Figure 6B:
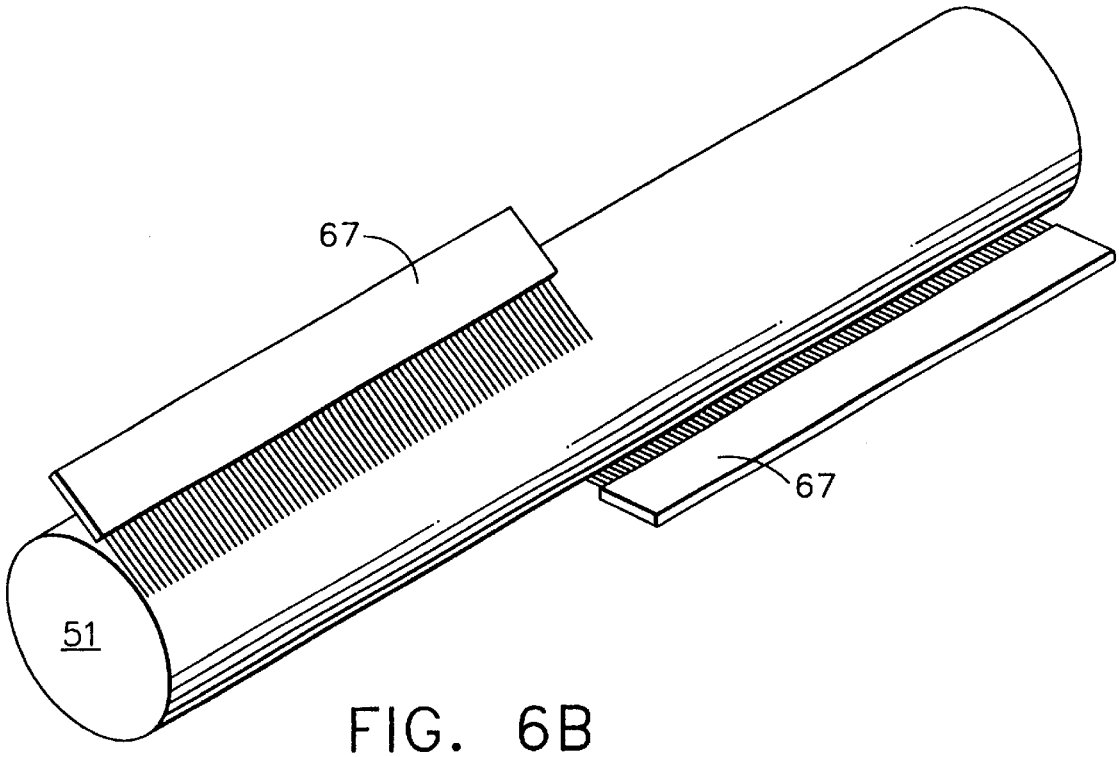

FIG. 5 illustrates a preferred embodiment of the present invention in which two linear brushes (67) are used to remove the water from the surface of the back-up roller (51). The bristles of the brushes can be made from any high-surface energy material, although stainless steel wire (thickness=about 10 to about 25 $\mu$m) is the preferred material. The brushes comprise metal housings holding the bristles. The bristles can consist of individual wires or bundles of wires. The wires can be spaced such that adjacent wires or bundles either do or do not touch each other. All wires or bundles of wire touch the surface of the back-up roller. A single brush may be used, although it is preferred to use two brushes as illustrated in FIG. 5. The brushes are mounted on the printer by attaching one brush to the lower exit guide (53). The second brush is attached to the fuser frame (69). The brushes act to reduce frictional drag torque on the back-up roller (51) and wear down the surface of the back-up roller less dramatically than do the other wipers described herein. This is possible since the use of two separate brushes allows longer, more flexible brushes to be designed and used in the present invention. Typically the brushes used in the present invention have a length of from about 200 to about 240 cm, preferably about 215 cm. They are preferably placed on opposite sides of the back-up roller (51). The brush or any other wiper used in the present invention must be such that it is in contact with at least a portion of the length of the surface of the back-up roller (51) and preferably is in contact with the entire functional length of the surface of the back-up roller (51). By "functional length" is meant that the wiper is in contact with substantially the entire length which would be in contact with the paper or other print media going through the fuser. If a single wiper is utilized (see FIG. 6A), then that wiper should be in contact with substantially the entire functional length of the back-up roller (51). However, a plurality of wipers may be used and placed along the length of the back-up roller (51) such that, taken as a whole, they contact substantially the entire functional length of the back-up roller. (See FIG. 6B).

What is claimed is:

1. An image-fixing device comprising:

a heater movable fixing member and a rotatable back-up member forming a nip therebetween, which members transport a recording material through said nip, thereby fixing toner to create an image on said recording material;

means for driving at least one of said members; and at least one wiping element, comprising a high-surface energy material, in contact with at least a portion of the surface of said back-up member, said wiping element having a generally flat surface extending away from said back-up member effective to move water away from said back-up member.

2. The image-fixing device according to claim 1 wherein the back-up member rotates as the recording material moves through the nip.

3. The image-fixing device according to claim 2 wherein the fixing member is a fuser belt.

4. The image-fixing device according to claim 3 wherein the wiping elements, taken together, are in contact with substantially the entire functional length of the surface of the back-up member.

5. The image-fixing device according to claim 4 wherein the wiping element is selected from a sheet of high-surface energy material, a layer of high-surface energy material carried on a supporting substrate, a brush made from high-energy material, and combinations thereof.

6. The image-fixing device according to claim 5 wherein the surface of the back-up roller includes a low surface energy material.

7. The image-fixing device according to claim 6 wherein the low energy material on the surface of the back-up member is Teflon.

8. The image-fixing device according to claim 6 wherein the wiping element is made from a material selected from polyimide, stainless steel, cotton, cellulose, polyaramid, and mixtures thereof.

9. The image-fixing device according to claim 8 wherein the wiping element is in the form of a brush.

10. The image-fixing device according to claim 9 wherein the bristles of the brush are made from stainless steel.

11. The image-fixing device according to claim 10 wherein the bristles of the brush are made from fine stainless steel wire.

12. The image-fixing device according to claim 5 wherein the wiping element comprises a forward wiping portion and a rear portion in the form of a "V" wherein the forward wiping portion (based on the direction of rotation of the back-up member), and the rear portion comprise a high surface energy material.

13. An image-fixing device comprising:

a heated movable fixing belt and a rotatable back-up roller forming a nip therebetween, said back-up roller being driven and said fixing belt being driven by said back-up roller to transport a recording material through said nip, thereby fixing toner to create an image on said recording material; and at least one wiping element, comprising a high-surface energy material, in contact with at least a portion of the surface of said back-up roller effective to remove water away from said back-up roller.

14. The image-fixing device according to claim 13 wherein the wiping elements, taken together, are in contact with substantially the entire functional length of the surface of the back-up member.

15. The image-fixing device according to claim 14 wherein the wiping element is selected from a sheet of high-surface energy material, a layer of high-surface energy material carried on a supporting substrate, a brush made from high-energy material, and combinations thereof.

16. The image-fixing device according to claim 15 wherein the wiping element is in the form of a brush.

17. The image-fixing device according to claim 16 wherein the bristles of the brush are made from stainless steel.

18. The image-fixing device according to claim 17 wherein bristles of the brush are made from stainless steel wire.

19. The image-fixing device according to claim 15 wherein the wiping element comprises a forward wiping portion and a rear portion in the form of a "V" wherein the forward wiping portion (based on the direction of rotation of the back-up member), and the rear portion comprise a high surface energy material.

* * * * *